US005700968A

United States Patent [19]

Blimke

[11] Patent Number: 5,700,968

[45] Date of Patent: Dec. 23, 1997

[54] PERFORATING GUN BRAKE

[76] Inventor: Ross Arthur Blimke, R.R. #1 Site 11 Box 16, Grande Prairie, Alberta, Canada, T8V 2Z8

[21] Appl. No.: 723,564

[22] Filed: Sep. 30, 1996

[51] Int. Cl.[6] ..... F42B 3/00; E21B 7/00

[52] U.S. Cl. ..... 102/312; 102/313; 175/4.54

[58] Field of Search ..... 102/312, 313; 175/4.54

[56] References Cited

U.S. PATENT DOCUMENTS

| | | | |
|---|---|---|---|
| 4,543,703 | 10/1985 | Wetzel et al. | 102/310 X |
| 4,657,089 | 4/1987 | Stout | 102/318 X |
| 4,759,291 | 7/1988 | Barker et al. | 102/275.5 X |
| 4,901,802 | 2/1990 | George et al. | 102/275.11 X |
| 4,911,251 | 3/1990 | George et al. | 102/275.11 X |
| 5,046,567 | 9/1991 | Aitken et al. | 102/200 |
| 5,223,665 | 6/1993 | Burleson et al. | 102/313 X |
| 5,346,014 | 9/1994 | Ross | 102/201 X |
| 5,413,045 | 5/1995 | Miszewski | 102/201 |
| 5,483,895 | 1/1996 | Tomek et al. | 102/312 |

*Primary Examiner*—Peter A. Nelson
*Attorney, Agent, or Firm*—Anthony R. Lambert

[57] ABSTRACT

A perforating gun brake includes a tubular housing, an annular piston and a mandrel. A first end of the piston is telescopically received in an interior bore at a second end of the tubular housing. The mandrel extends through an interior bore of the piston into the interior bore of the tubular housing. An hydraulic fluid chamber is formed in the interior bore of the tubular housing. A spring biases the piston toward a first end of the mandrel. The movement of the piston along the mandrel is resisted by hydraulic fluid in the hydraulic fluid chamber. An explosive charge is positioned on a first sealing assembly for the hydraulic chamber. Several gripping members are pivotally mounted to an exterior surface of the piston. The gripping members are movable between a retracted position and a deployed position. The gripping members are moved to the deployed position by a deploying collar that is released in response to pressure exerted upon detonation of the perforating gun. The deploying collar holds the gripping members in the deployed position until the first sealing assembly is removed by detonation of the charge, thereby allowing hydraulic fluid to escape from the hydraulic chamber. As the hydraulic chamber is emptied of hydraulic fluid the piston moves along the mandrel. The movement of the piston along the mandrel moves the gripping members away from the deploying collar allowing the gripping members to return to the retracted position.

6 Claims, 2 Drawing Sheets

PERFORATING GUN BRAKE

FIELD OF THE INVENTION

The present invention relates to a perforating gun brake and, in particular, a perforating gun brake used when the well is underbalanced.

BACKGROUND OF THE INVENTION

Perforating guns are used to create perforations in a well casing so that oil and gas can flow from an underground formation into a well bore. A common type of perforating gun is lowered into a well on a wireline and then triggered electrically via the wireline.

A well is said to be "underbalanced" when the pressure within the formation is greater than the pressure within the well. When the well casing is perforated in an underbalanced well, there is a rapid influx of fluids into the well bore. This is viewed as desirable as it provides a good clean out of drilling mud, formation sand, cement residue and other matter which may otherwise clog the formation and retard the flow of gas and oil. However, as fluids enter the well casing they tend to drive the perforating gun up the well bore. When this occurs the wireline often gets tangled around the perforating gun or damaged. A damaged wireline is prone to breakage when pulling the perforating gun to surface, especially if the perforating gun becomes temporarily stuck in the well bore as a result of being pulled to surface at an angle due to tangles in the wireline. The wireline is a braided line. As strands of wire break, a mass of wire strands is created. The perforating gun is inserted into the well bore through a lubricator which is positioned above the blind rams of the Blow out Preventer. The lubricator has a rubber pressure fitting through which the wireline extends. The pressure fitting tightly engages the rubber to squeeze and deform it to maintain some pressure containment notwithstanding the fact that the wireline extends through it. When strands of the wireline are broken and tangled forming a mass, it is difficult, and sometimes impossible, to pull the perforating gun through the blow out preventer to a position where the blind rams can be closed and the perforating gun removed. In such cases, there is no alternative than to cut the wireline and use a fishing tool to subsequently remove the perforating gun from the well.

SUMMARY OF THE INVENTION

What is required is a perforating gun brake that will hold the perforating gun in position until the initial surge of fluids into the well bore passes and the pressure in the wellbore is substantially equal to formation pressure.

According to the present invention there is provided a perforating gun brake which includes a tubular housing, an annular piston and a mandrel. The tubular housing has an exterior surface, a first end, a second end, and an interior surface that defines an interior bore that extends from the first end to the second end. The first end of the tubular housing includes coupling means for coupling with a perforating gun. The annular piston has an exterior surface, a first end, a second end, and an interior bore that extends between the first end and the second end. The first end of the annular piston is telescopically received in the interior bore at the second end of the tubular housing. The mandrel has an exterior surface, a first end, a second end, and a wire conduit that extends between the first end and the second end. The mandrel extends through the interior bore of the annular piston into the interior bore of the tubular housing. The mandrel serves as a guide for the telescopic movement of the annular piston. An annular hydraulic fluid chamber is formed in the interior bore of the tubular housing between the exterior surface of the mandrel and the interior surface of the tubular housing. The hydraulic fluid chamber has a first end and a second end. First sealing means are positioned at the first end of the hydraulic fluid chamber between the exterior surface at the first end of the mandrel, and the interior surface of the tubular housing. Second sealing means are positioned at the second end of the hydraulic fluid chamber between the exterior surface of the annular piston and the interior surface of the tubular housing. Piston biasing means are provided on the mandrel, exerting a biasing force urging the annular piston toward the first end of the mandrel. The movement of the piston along the mandrel is resisted by hydraulic fluid in the hydraulic fluid chamber. An electrically actuatable flow means is positioned on the first sealing means. Several gripping members are pivotally mounted to the exterior surface of the annular piston spaced from the first end. The gripping members are movable between a retracted position substantially parallel to the exterior surface and a deployed position extending outwardly at an angle from the exterior surface. Gripping members deploying means are mounted to the exterior surface of the mandrel. The gripping members deploying means are pressure responsive, such that the gripping members deploying means exerts a biasing force to move the gripping members to the deployed position in response to pressure exerted upon detonation of the perforating gun. A pair of wires extend through the wire conduit from the second end to the first end of the mandrel. One wire of the pair of wires is connected to the electrically actuatable flow means. A direct current positive/negative firing module is connected to the pair of wires. A positive electric pulse or a negative electric pulse can be sent through one wire of the pair of wires to trigger the perforating gun. The other form of electric pulse can be sent through another wire of the pair of wires to trigger the electrically actuatable flow means positioned on the first sealing means. Upon detonation of the perforating gun the pressure responsive biasing means moves the gripping members to the deployed position. The gripping members remain in the deployed position until the electrically actuatable flow means is triggered to allow hydraulic fluid to escape from the hydraulic chamber. As the hydraulic chamber is emptied of hydraulic fluid the annular piston moves telescopically into the tubular housing and is urged by the piston biasing means toward the first end of the mandrel. The movement of the annular piston along the mandrel moves the gripping members away from the gripping members deploying means allowing the gripping members to return to the retracted position.

The perforating gun brake, as described above, deploys gripping members to maintain its position during the initial surge of fluids into the well bore. The gripping members are maintained in their deployed position the pressure in the well bore is substantially equal to formation pressure. The time for this to occur varies with the application. Once pressure equalization has occurred, the flow means can be electrically actuated to allow sufficient hydraulic fluid to escape to cause the gripping members to return to the retracted position. The preferred form of electrically actuated flow means is a charge which can be detonated to remove an aluminum pin. The preferred means for deploying the gripping members includes a collar biased by a spring. The collar is secured to the exterior surface of the mandrel by screw-form shear pins with the spring in compression. The force associated with the detonation of the perforating gun serves to shear the shear pins whereby the collar is pushed into engagement with the gripping members by the spring and moves the gripping members to the deployed position. The deploying collar holds the gripping members in their deployed position until the annular piston moves along the mandrel; positioning the gripping members out of reach of the deploying collar. This can only occur when hydraulic fluid has been released from the hydraulic chamber by the removal by detonation of all or part of the first seal assembly. It is preferred that biasing means be provided to urge the gripping members back into the retracted position.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 2:
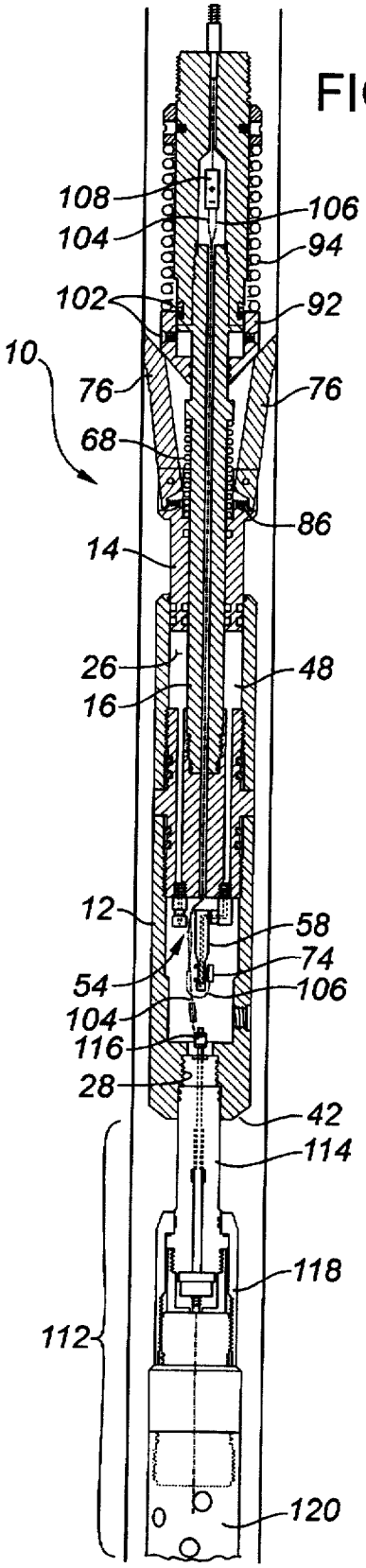
FIG. 2 is a side elevation view, in section, of the perforating gun brake illustrated in FIG. 1, secured to a perforating gun and with gripping members in a deployed position.
Figure 3:
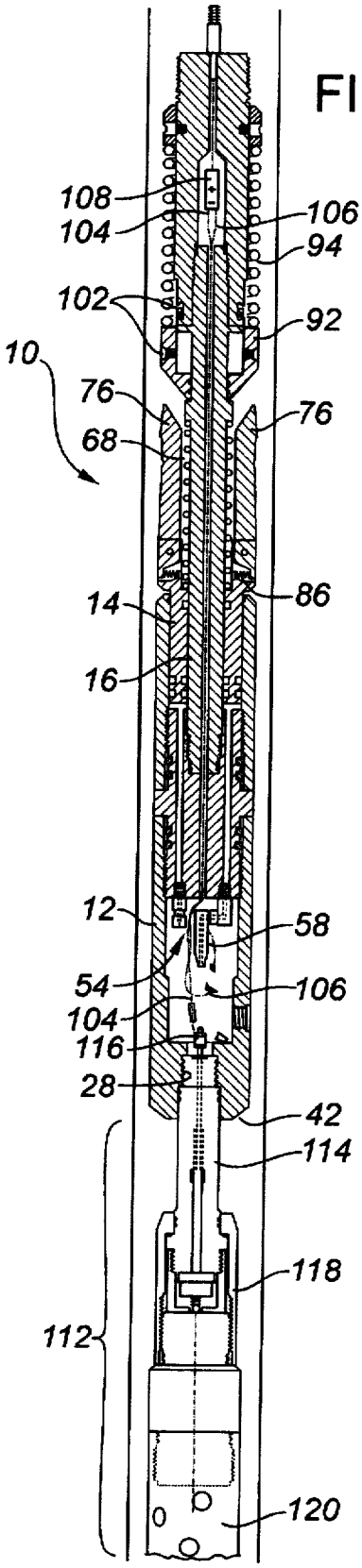
FIG. 3 is a side elevation view, in section, of the perforating gun brake illustrated in FIG. 1, secured to a perforating gun and with gripping members back in a retracted position after deployment.

The preferred embodiment, a perforating gun brake generally identified by reference numeral 10, will now be described with reference to FIGS. 1 through 3.

Figure 1:
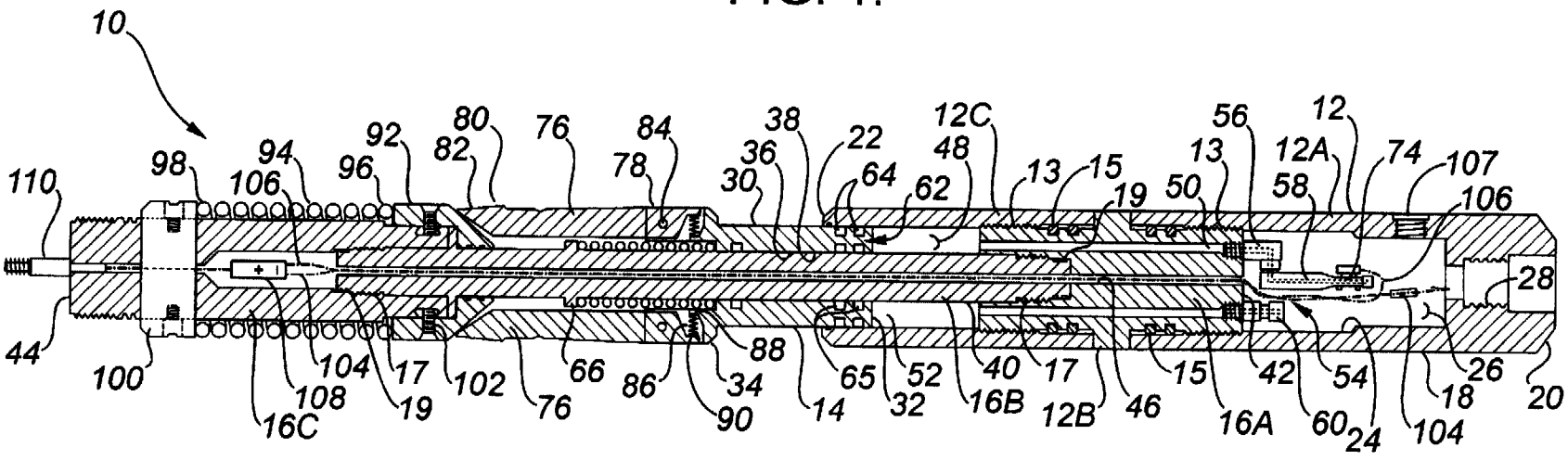
FIG. 1 is a side elevation view, in section, of a perforating gun brake constructed in accordance with the teachings of the present invention.

Referring to FIG. 1, perforating gun brake 10 includes a tubular housing 12, an annular piston 14 and a mandrel 16. The tubular housing 12 having an exterior surface 18, a first end 20, a second end 22, and an interior surface 24 that defines an interior bore 26 that extends from first end 20 to second end 22. First end of tubular housing 12 includes a coupling 28 for coupling with a perforating gun (not shown in FIG. 1). In order to facilitate assembly, tubular housing 12 is fabricated from three threadedly connected components **12*a*, 12*b*, 12*c*. Components 12*a*, 12*b*, 12*c*, are connected at threaded connections 13. Each threaded connection is sealed by O ring seals 15. Piston 14 has an exterior surface 30, a first end 32, a second end 34, and an interior surface 36 which defines an interior bore 38 that extends between first end 32 and second end 34. First end 32 of annular piston 14 is telescopically received in interior bore 26 at second end 22 of tubular housing 12. Mandrel 16 has an exterior surface 40, a first end 42, a second end 44, and a wire conduit 46 that extends between first end 42 and second end 44. Mandrel 16 extending through interior bore 38 of annular piston 14 into interior bore 26 of tubular housing 12. Mandrel 16 serves as a guide for the telescopic movement of annular piston 14, as will be hereinafter further described. In order to facilitate assembly, mandrel 16 is fabricated from three threadedly connected components 16*a*, 16*b*, and 16*c*. Components 16*a*, 16*b*, 16*c*, are connected at threaded connections 17. Each threaded connection is sealed by O ring seals 19. An annular hydraulic fluid chamber 48 is formed in interior bore 26 of tubular housing 12 between exterior surface 40 of mandrel 16 and interior surface 24 of tubular housing 12. Hydraulic fluid chamber 48 has a first end 50 and a second end 52. A first sealing assembly, generally indicated by reference numeral 54, is positioned at first end 50 of hydraulic fluid chamber 48 between exterior surface 40 at first end 42 of mandrel 16, and interior surface 24 of tubular housing 12. In FIG. 1, first sealing assembly 54 includes a fitting 56 to which is secured a hollow aluminum pin-like closure 58. A one way valve 60 is provided in order to fill hydraulic fluid chamber 48 with hydraulic fluid. A second sealing assembly, generally indicated by reference numeral 62, is positioned at second end 52 of hydraulic fluid chamber 48 between exterior surface 30 of annular piston 14 and interior surface 26 of tubular housing 12. In FIG. 1, sealing assembly 62 includes a pair of O ring seals 64. A further pair of O ring seals 65 provide a seal between interior surface 36 of annular piston 14 and exterior surface 40 of mandrel 16. A raised shoulder 66 is provided on exterior surface 40 of mandrel 16. A piston biasing spring 68 is provided which encircles mandrel 16. Piston biasing spring 68 has a first end 70 and a second end 72. First end 70 engages second end 34 of annular piston 14. Second end 72 engages shoulder 66. Piston biasing spring 68 exerting a biasing force which urges annular piston 14 toward first end 42 of mandrel 16. This movement is resisted, however, by the presence of hydraulic fluid in hydraulic fluid chamber 48. An electrically detonatable explosive charge 74 is positioned on first sealing assembly 54 and serves an electrically actuatable means for permitting flow of hydraulic fluid from hydraulic fluid chamber 48. Upon detonation of explosive charge 74, hollow aluminum pin-like closure 58 is removed. Several gripping members 76 are pivotally mounted to exterior surface 30 at second end 34 of annular piston 14. Gripping members 76 are movable between a retracted position and a deployed position. In the retracted position, gripping members 76 are positioned substantially parallel to exterior surface 30, as illustrated in FIG. 1. In the deployed position, gripping members 76 extend outwardly at an angle from exterior surface 30, as illustrated in FIG. 2. Referring to FIG. 1, each of gripping members 76 has a first end 78 and a second end 80. Gripping feet 82 are positioned at second end 80. A pivot pin 84 is spaced from first end 78. A retracting spring 86 is provided having a first end 88 and a second end 90. Retracting spring 86 is placed in compression with first end 88 engaging exterior surface 30 of annular piston 14 and second end 90 engaging first end 78 of gripping member 76. Retracting spring 86 provides a force which pivots gripping member 76 to the retracted position. A gripping members deploying collar 92 is slidably mounted to exterior surface 40 of mandrel 16. Deploying collar 92 is biased by a spring 94. Spring 94 has a first end 96 and a second end 98. First end 96 exerts a force upon deploying collar 92. Second end 98 exerts a force upon a fixed retaining collar 100 on exterior surface 40 of mandrel 16. Deploying collar 92 is secured to exterior surface 40 of mandrel 16 by screw-form shear pins 102, with spring 94 placed in a compressed state so that it will release its stored energy upon shear pins 102 being sheared. An insulated pair of wires 104 and 106 extend through wire conduit 46 from second end 44 to first end 42 of mandrel 16. Wires 104 and 106 are connected to a diode 108 which serves as a direct current positive/negative firing module. Wire 104 serves as a D.C. positive electric wire. Wire 106 serves as a D.C. negative electric wire. Diode 108 is connected to an electrical contact pigtail 110 at second end 44 of mandrel 16, which that permits connection to a wireline extending to surface (not shown). D.C. positive electric wire 104 is adapted to be connected to a perforating gun, as will hereinafter be further described. D.C. negative electric wire 106 is connected to electrically detonatable explosive charge 74. A port plug 107** is provided to allow access for the purpose of making this connection. Referring to FIGS. 2 and 3, perforating gun brake 10 is illustrated connected to a perforating gun assembly, generally indicated by reference numeral 112. Perforating gun assembly 112 includes a quick change connection 114 with a quick change electric terminal 116, a perforating gun top sub 118, and a perforating gun 120.

The use and operation of perforating gun brake 10 will now be described with reference to FIGS. 1 through 3. Referring to FIGS. 2 and 3, coupling 28 is used to connect perforating gun brake 10 to quick change connection 114 of perforating gun assembly 112. D.C. Positive electric wire 104 is connected to electric terminal 116 of perforating gun assembly 112. Perforating gun brake is then lowered on a wireline (not shown) to the position within a well casing where perforation is desired. Once perforating gun 120 is in position, a positive electric pulse is sent through the wireline. Once the electric pulse reaches diode 108 it is routed along D.C. positive electric wire 104 and used to trigger perforating gun 120. The detonation of perforating gun 120 provides a jarring impact to perforating gun brake 10 which serves to shear pins 102. The shearing of shear pins 102 leaves deploying collar 92 free to travel along mandrel 16 and releases the stored energy in spring 94. Spring 94 pushes deploying collar 92 along mandrel 16. Deploying collar 92, in turn, pushes gripping members 76 outwardly to the deployed position, illustrated in FIG. 2. Gripping members 76 remain held in the deployed position by deploying collar 92. When it is intended that gripping members 76 should be released, a negative electric pulse is sent through the wireline. When the electric pulse reaches diode 108 it is routed through D.C. negative electric wire 106 to trigger the electrically detonatable explosive charge 74, positioned on first sealing assembly 54. Hollow aluminum pin-like closure 58 is blown out of position upon explosive charge 74 being detonated, allowing hydraulic fluid to escape from hydraulic chamber 48. As hydraulic chamber 48 is emptied of hydraulic fluid, piston 14 is free to move telescopically into interior bore 26 of tubular housing 12. Piston 14 is urged by piston biasing spring 68 toward first end 42 of mandrel 16; this movement, which was formerly resisted by hydraulic fluid in hydraulic chamber 48, is unopposed. Referring to FIG. 3, movement of annular piston 14 along mandrel 16, moves gripping members 76 away from deploying collar 92, which was holding them in the deployed position. Once free of deploying collar 92, the force exerted by retracting spring 86 is able to pivot gripping members 76 back to the retracted position.

It will be apparent to one skilled in the art the braking action provided by perforating gun brake 10. In particular, it will be apparent that perforating gun brake 10 prevents a premature release of gripping members 76, as gripping members 76 are held in the deployed position until an appropriate signal is sent to detonate explosive charge 74. It will finally be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A perforating gun brake, comprising:

a tubular housing having an exterior surface, a first end, a second end, and an interior surface that defines an interior bore that extends from the first end to the second end, the first end of the tubular housing including coupling means for coupling with a perforating gun;

an annular piston having an exterior surface, a first end, a second end, and an interior bore that extends between the first end and the second end, the first end of the annular piston being telescopically received in the interior bore at the second end of the tubular housing;

a mandrel having an exterior surface, a first end, a second end, and a wire conduit that extends between the first end and the second end, the mandrel extending through the interior bore of the annular piston into the interior bore of the tubular housing, the mandrel serving as a guide for the telescopic movement of the annular piston;

an annular hydraulic fluid chamber formed in the interior bore of the tubular housing between the exterior surface of the mandrel and the interior surface of the tubular housing, the hydraulic fluid chamber having a first end and a second end;

first sealing means positioned at the first end of the hydraulic fluid chamber between the exterior surface at the first end of the mandrel, and the interior surface of the tubular housing;

second sealing means positioned at the second end of the hydraulic fluid chamber between the exterior surface of the annular piston and the interior surface of the tubular housing;

piston biasing means on the mandrel exerting a biasing force urging the annular piston toward the first end of the mandrel, such movement being resisted by hydraulic fluid in the hydraulic fluid chamber;

an electrically actuated flow means positioned on the first sealing means;

several gripping members pivotally mounted to the exterior surface of the annular piston spaced from the first end, the gripping members being movable between a retracted position substantially parallel to the exterior surface and a deployed position extending outwardly at an angle from the exterior surface;

gripping members deploying means mounted to the exterior surface of the mandrel, the gripping members deploying means being pressure responsive, such that the gripping members deploying means exerts a biasing force to move the gripping members to the deployed position in response to pressure exerted upon detonation of the perforating gun;

a pair of wires extending through the wire conduit from the second end to the first end of the mandrel, the wireline being connected to the electrically actuated flow means;

a direct current positive/negative firing module connected to the wireline, such that one of a positive electric pulse and a negative electric pulse can be sent through one of the pair of wires to trigger the perforating gun and the other of the positive electric pulse and the negative electric pulse can be sent through the other of the pair of wires to trigger the electrically actuated flow means positioned on the first sealing means;

upon detonation of a perforating gun the pressure responsive biasing means moves the gripping members to the deployed position, the gripping members remain in the deployed position until an electric pulse triggers the electrically actuated flow means to allow hydraulic fluid to escape from the hydraulic chamber, as the hydraulic chamber is emptied of hydraulic fluid the annular piston moves telescopically into the tubular housing is urged by the piston biasing means toward the first end of the mandrel, the movement of the annular piston along the mandrel moves the gripping members away from the gripping members deploying means allowing the gripping members to return to the retracted position.

2. The perforating gun brake as defined in claim 1, wherein the gripping members deploying means includes a collar biased by a spring, the collar being secured to the exterior surface of the mandrel by shear pins with the spring in compression, the force associated with the detonation of the perforating gun serving to shear the shear pins whereby the collar is pushed into engagement with the gripping members by the spring moving the gripping members to the deployed position.

3. The perforating gun brake as defined in claim 1, wherein the electrically actuatable flow means is an explosive charge positioned on the first sealing means.

4. The perforating gun brake as defined in claim 1, wherein secondary biasing means urge the gripping members into a normally retracted position.

5. The perforating gun brake as defined in claim 3, wherein each of the gripping members have a first end and a second end, gripping feet are positioned at the second end, a pivot pin is spaced from the first end, and the secondary biasing means includes a compression spring having a first end and a second end, the first end of the spring engaging the exterior surface of the annular piston, the second end of the spring engaging the first end of the gripping member, thereby urging the gripping member to the retracted position.

6. A perforating gun brake, comprising:

a tubular housing having an exterior surface, a first end, a second end, and an interior surface that defines an interior bore that extends from the first end to the second end, the first end of the tubular housing including a coupling for coupling with a perforating gun;

an annular piston having an exterior surface, a first end, a second end, and an interior bore that extends between the first end and the second end, the first end of the annular piston being telescopically received in the interior bore at the second end of the tubular housing;

a mandrel having an exterior surface, a first end, a second end, and a wire conduit that extends between the first end and the second end, the mandrel extending through the interior bore of the annular piston into the interior bore at the first end of the tubular housing, the mandrel serving as a guide for the telescopic movement of the annular piston;

an annular hydraulic fluid chamber formed in the interior bore of the tubular housing between the exterior surface of the mandrel and the interior surface of the tubular housing, the hydraulic fluid chamber having a first end and a second end;

first sealing assembly positioned at the first end of the hydraulic fluid chamber between the exterior surface at the first end of the mandrel, and the interior surface of the tubular housing;

second sealing assembly positioned at the second end of the hydraulic fluid chamber between the exterior surface of the annular piston and the interior surface of the tubular housing;

piston biasing spring on the mandrel exerting a biasing force urging the annular piston toward the first end of the mandrel, such movement being resisted by hydraulic fluid in the hydraulic fluid chamber;

an electrically detonatable explosive charge positioned on the first sealing assembly;

several gripping members pivotally mounted to the exterior surface of the annular piston spaced from the first end, the gripping members being movable between a retracted position substantially parallel to the exterior surface and a deployed position extending outwardly at an angle from the exterior surface, each of the several gripping members having a first end and a second end, gripping feet are positioned at the second end and a pivot pin being spaced from the first end;

a retracting spring placed in compression with a first end engaging the exterior surface of the annular piston and a second end engaging the first end of the gripping member, thereby pivoting the gripping member to the retracted position;

a gripping members deploying collar slidably mounted to the exterior surface of the mandrel, the deploying collar being biased by a spring, the collar being secured to the mandrel by screw-form shear pins with the spring held in a compressed state;

a pair of wires extending through the wire conduit from the second end to the first end of the mandrel, one of the pair of wires being connected to the electrically detonatable explosive charge;

a direct current positive/negative firing module connected to the pair of wires, such that a positive electric pulse can be sent through one of the pair of wires to trigger the perforating gun and a negative electric pulse can be sent through the another of the pair of wires to trigger the electrically detonatable explosive charge positioned on the first sealing assembly;

upon detonation of the perforating gun in response to the positive electric pulse, the shear pins are sheared releasing the deploying collar which slides along the mandrel in response to a biasing force provided by the spring pushing the gripping members to the deployed position, the gripping members remain held in the deployed position by the deploying collar until the negative electric pulse is sent to trigger the electrically detonatable explosive charge, the first sealing assembly is blown out of position upon the charge being detonated allowing hydraulic fluid to escape from the hydraulic chamber, as the hydraulic chamber is emptied of hydraulic fluid the annular piston moves telescopically into the tubular housing and is urged by the piston biasing spring toward the first end of the mandrel, the movement of the annular piston along the mandrel moves the gripping members away from the deploying collar, the retracting spring is then able to pivot the gripping members back to the retracted position.

* * * * *